United States Patent [19]

Kuroki et al.

[11] 4,203,784

[45] May 20, 1980

[54] GRAIN ORIENTED ELECTROMAGNETIC STEEL SHEET

[75] Inventors: Katsuro Kuroki, Kitakyushu; Osamu Tanaka, Nohgata, both of Japan

[73] Assignee: Nippon Steel Corporation, Tokyo, Japan

[21] Appl. No.: 902,811

[22] Filed: May 4, 1978

[30] Foreign Application Priority Data

May 4, 1977 [JP] Japan ..... 52-50667

[51] Int. Cl.[2] ..... H01F 1/04

[52] U.S. Cl. ..... 148/111; 148/31.5

[58] Field of Search ..... 148/111, 31.55, 31.5

[56] References Cited

U.S. PATENT DOCUMENTS

| | | | |
|---|---|---|---|
| 2,920,296 | 1/1960 | Neurath | 148/111 |
| 3,533,861 | 10/1970 | Foster et al. | 148/31.55 |
| 3,647,575 | 3/1972 | Fiedler | 148/111 |
| 3,670,278 | 6/1972 | Foster et al. | 148/31.55 |
| 3,990,923 | 11/1976 | Takashina et al. | 148/111 |

*Primary Examiner*—L. Dewayne Rutledge
*Assistant Examiner*—John P. Sheehan
*Attorney, Agent, or Firm*—Wenderoth, Lind & Ponack

[57] ABSTRACT

A grain oriented electromagnetic steel sheet has a plurality of linear fine strains having a traverse section of a concave hollow on it in the steel sheet shows a very low iron loss in its use.

12 Claims, 21 Drawing Figures

1 A STEEL SHEEL WITH A GLASSY FILM

2 A STEEL SHEET WITH A GLASSY FILM PROVIDED WITH FINE STRAINS

3 A STEEL SHEET WITHOUT A GLASSY FILM PROVIDED WITH FINE STRAINS

4 A STEEL SHEET, FROM WHICH GLASSY FILM IS REMOVED

SECTIONAL VIEW (X200)

1 A STEEL SHEEL WITH A GLASSY FILM

2 A STEEL SHEET WITH A GLASSY FILM PROVIDED WITH FINE STRAINS

3 A STEEL SHEET WITHOUT A GLASSY FILM PROVIDED WITH FINE STRAINS

4 A STEEL SHEET, FROM WHICH GLASSY FILM IS REMOVED

FIG. 6 ( c )
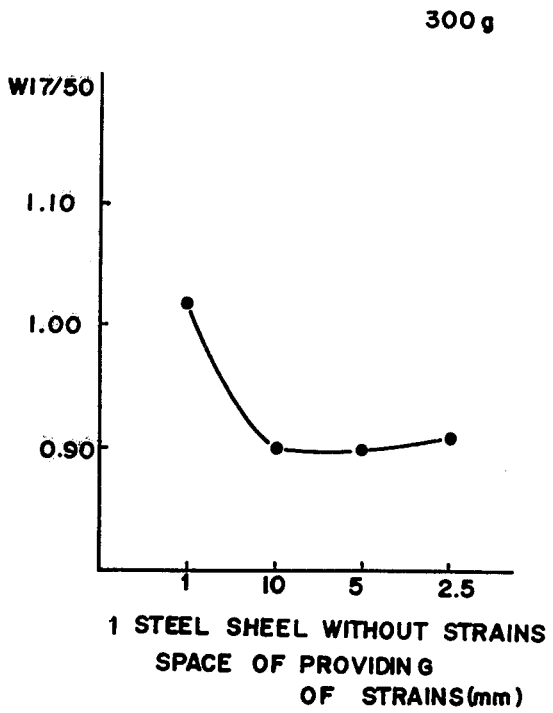

GRAIN ORIENTED ELECTROMAGNETIC STEEL SHEET

DETAILED DESCRIPTION OF THE INVENTION

This invention relates to a grain oriented electromagnetic steel sheet having linear fine deformed portions which are hereinafter referred to as fine strains or linear strains and having a very low iron loss. The grain oriented electromagnetic steel sheet is a crystal-oriented steel sheet wherein most of the crystal grains are magnetically accumulated in ideal directions. Such a steel sheet is in general classified into two kinds of steel sheets i.e. a grain oriented steel sheet and a double oriented steel sheet. When they are represented by Miller indices, the former consists of the crystal grains having (110) surface in parallel with the surface of the steel sheet and easily magnetizable axis [100] in parallel with the rolling direction and the latter consists of the crystal grains having (100) surface in parallel with the surface of the steel sheet and easily magnetizable axis [100] in parallel with the rolling direction.

It is preferable to apply this invention to the grain oriented electromagnetic steel sheet and, therefore, the following descriptions are directed to the grain oriented silicon steel sheet, the ideal directions of which are represented by (100) and [001]. Of course, the "electromagnetic steel sheet" and the "silicon steel sheet" herein have the same meaning.

The excitation characteristics of a steel sheet is improved by allowing all the crystal grains of the steel sheet to come near (110) [001] ideal directions and therewith the iron loss thereof is generally decreased. Therefore, many attempts have been made to elevate the degree of the accumulation of the above texture. As a result, the electromagnetic steel sheet showing such a low iron loss that W17/50 is 1.03 watt/kg or so has nowadays been manufactured industrially when the thickness of the steel sheet is 0.30 mm. In this connection; the W17/50 means the iron loss in the magnetic flux density of 1.7 T. In addition, the T is short for Tesla which is the unit of magnetic flux density ($wb/m^2$).

It has, however, been gradually made clear that it is difficult to further decrease the iron loss rapidly by only allowing the crystal grains to come near the ideal directions. The reason is as follows:

In general, the iron loss depends upon the size of the crystal grain as well as the excitation characteristics. The crystal grain must be coarsened to a certain extent in order to enhance the excitation characteristics whereby the amount of the decrease in iron loss is offset.

Therefore, the other means must be employed to further reduce the iron loss below the lowest level of iron loss at the present time. The method of giving a steel sheet to a tension is known as one of the other means. The method of imparting the tension to the steel sheet by forming an insulating coating thereon has been proposed in this industrial field. However, there is a limitation in the tension which can be obtained by the coating and, therefore, there is also a limitation in the iron loss improved by the impartment of the tension. As a result of this, the lowest level of the iron loss obtained by the addition of the effect of the tension has been the above-mentioned 1.03 W/Kg or so.

There is another method for reducing the iron loss. The feature of the method is to finish the surface of the steel sheet subjected to a finishing, or final, annealing to a mirror, or speculum, condition by a chemical or electrolytic abrasion. The iron loss of the steel sheet produced by the method depends largely upon the degree of the smoothness of the surface and, when the steel sheet is coated with an insulating coating, the iron loss of the steel sheet is deteriorated.

In addition, another method for decreasing the iron loss is disclosed in U.S. Pat. No. 3,647,575. The feature of the method is to provide flaws, or grooves, to the surface of a steel sheet. The provision of the grooves is carried out by scratching or strongly rubbing the surface of the steel sheet with a knife, a razor blade or such a very hard material as emery powder or a steel brush. In the method the decrease of the iron loss can be expected but when the steel sheets are piled, or stacked, the space factor, or stacking factor, is not only deteriorated steeply but also the strain of the magnetism is increased largely. Furthermore, there is the fatal disadvantage that, when the steel sheets provided with the flaws are stacked, or piled, an expected value of the iron loss can not be obtained. That is, in the steel sheet provided with the flaws the Epstein value is higher than SST value wherein the SST is a single sheet measuring apparatus which is hereinafter referred to as SST.

The reasons are assumed as follows:

In the steel sheet the portions provided with the flaws become thinner that the other portions and, therefore, a part of the flux is discharged from the surfaces of the steel sheet. Consequently, in the SST measurement the decrease of the iron loss is observed but, when the steel sheets are piled, the flux discharged from one of the steel sheets piled is received by the above and below steel sheets adjacent to the one so that the magnetizm element of the direction vertical to the steel sheet is generated and thereby the iron loss is deteriorated.

Thus, the providing of the flaws has the fatal disadvantage, in case that the steel sheets provided with the flaws are employed in a pile as a core for a transformer or a coiled core. Therefore, the providing of the flaws has not been applied to any commercial articles or devices.

It is, therefore, an object of this invention to overcome all the disadvantages as mentioned above.

It is another object of this invention to provide a grain oriented electromagnetic steel sheet having a very low iron loss which can be employed commercially.

It is still another object of this invention to provide a grain oriented electromagnetic steel sheet provided with fine strains but without any return strains due to the provision of the fine strains.

According to this invention, there is provided a grain oriented electromagnetic steel sheet (1) which comprises a base steel sheet with an inorganic film or a glassy film subjected to a final annealing, the steel containing Si in an amount of 4.0% or less, and a plurality of linear fine strains imparted to the base steel through the film.

According to this invention, there is also provided a steel sheet (2) according to the steel sheet (1) in which the strain is given by a body of rotation.

According to this invention, there is also provided a steel sheet (3) according to the steel sheets (1) and (2) in which the direction of the strain is traverse to the rolling direction.

According to this invention, there is also provided a steel sheet (4) according to the steel sheets (1) to (3) in which the strain has the depth of 5 μm or less and the width of 600 μm or less, and the distance between the adjacent two strains is 2.5 to 10 mm.

According to this invention, there is also provided a steel sheet (5) according to steel sheets (1) to (4) in which the excitation characteristics (B8) of the base steel sheet is 1.90 or more.

According to this invention, there is also provided a steel sheet (6) according to the steel sheets (1) to (5) in which the base steel further has a coating consisting essentially of one member of the group consisting of compounds of phosphoric acid system, compounds of organic system and a ultraviolet ray hardening resin on the film.

According to this invention, there is also provided a steel sheet (7) according to the steel sheets (1) to (6) in which the direction of the fine strains is 30° or more to the rolling direction of the steel sheet.

According to this invention, there is also provided a steel sheet (8) according to the steel sheet (7) in which the direction of the fine strain is 45° or more to the rolling direction of the steel sheet.

According to this invention, there is also provided a steel sheet (9) according to the steel sheet (1) in which said strain is its very small amount in the traverse direction.

BRIEF DESCRIPTION OF THE DRAWINGS

FIG. 1 (*b*) is a microphotograph (200 magnifications) of the sectional view of the same electromagnetic steel sheet as that of FIG. 1 (*a*) provided with a flaw by the sharp edge of a knife.

FIG. 2 (*b*) is a microphotograph (100 magnifications) showing the aspect of the flaw of the same steel sheet as that of FIG. 2 (*a*) provided by a knife of fine strains imparted and the rate of improvement of the L direction of iron loss.

FIG. 2 (*c*) is an enlarged sectional view of FIG. 2 (*a*).

FIG. 2 (*d*) is an enlarged sectional view of FIG. 2 (*b*).

FIG. 2 (*e*) is a sectional view showing the case that two steel sheets of FIG. 2 (*c*) are stacked.

FIG. 2 (*f*) is a sectional view showing the case that two steel sheets of FIG. 2 (*d*) are stacked.

This invention is further described with reference to the accompanying drawings.

Figure 4A:
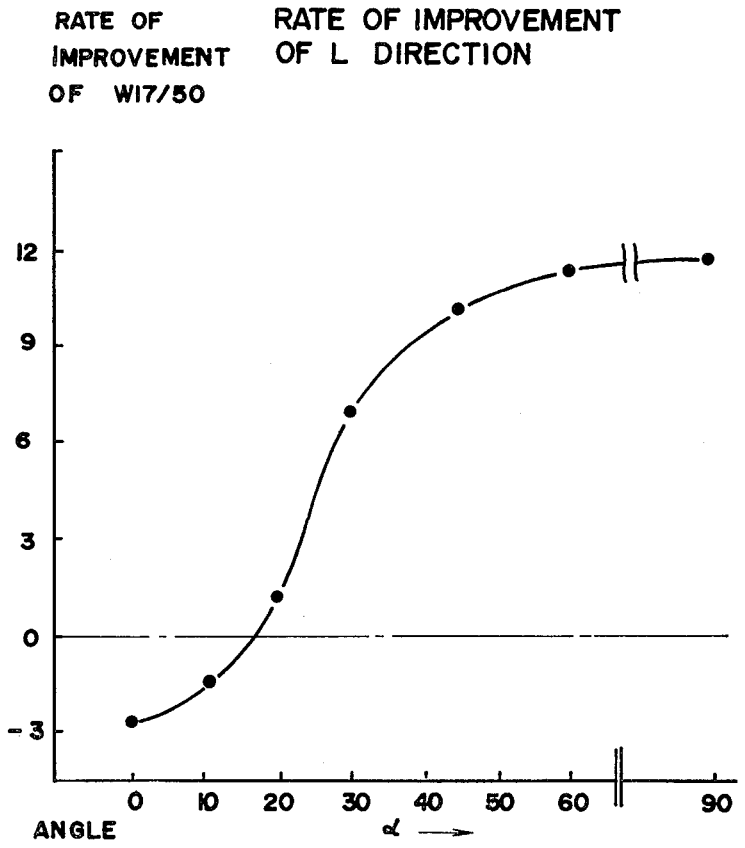
FIG. 4 (*a*) is a graph showing the relation between the direction.
Figure 4B:
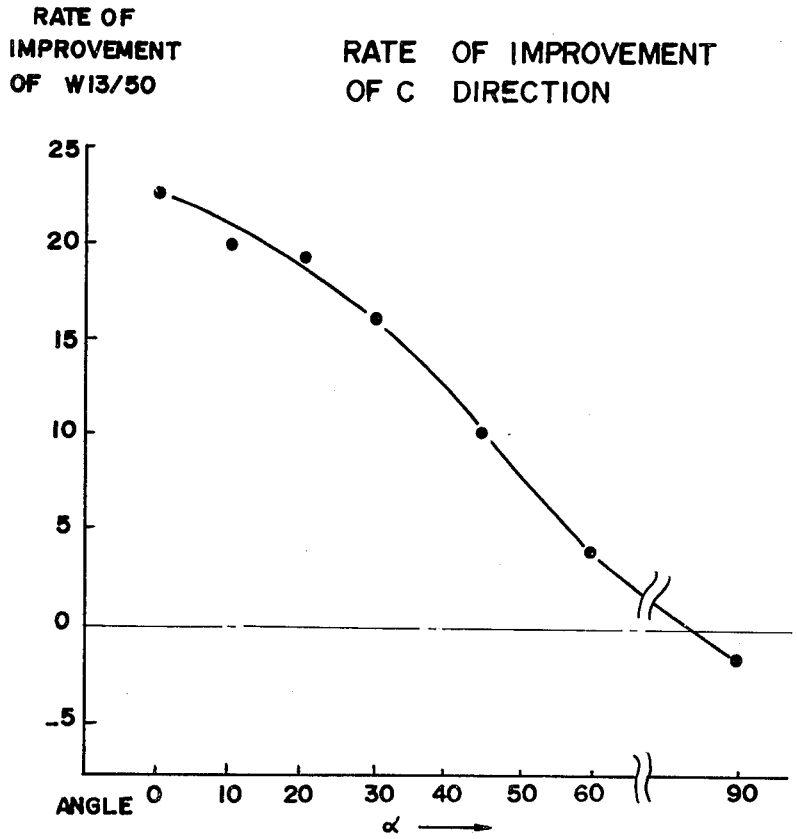

FIG. 4 (*b*) is a graph showing the relation between the direction of fine strains imparted and the rate of improvement of the C direction the iron loss of FIG. 4 (*a*).

Figure 5:
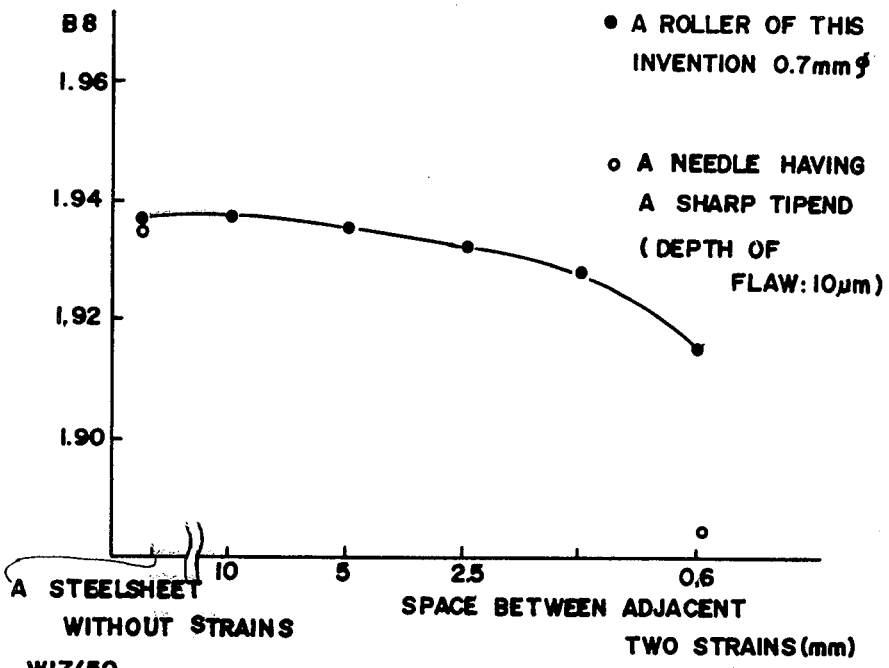
Figure 5B:
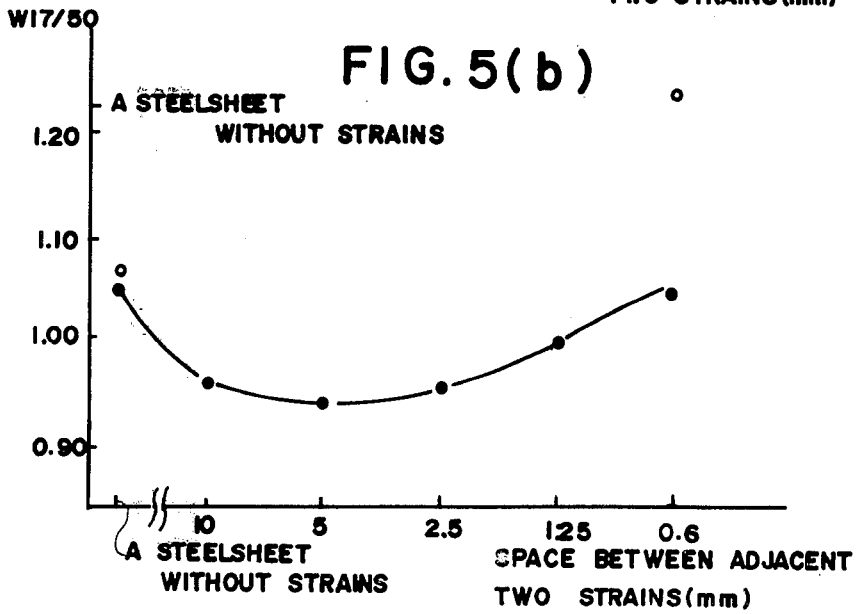

FIGS. 5 (*a*) and (*b*) are graphs showing the relation between the distance, or space, of the impartment of fine strains and the iron loss.

Figure 6A:
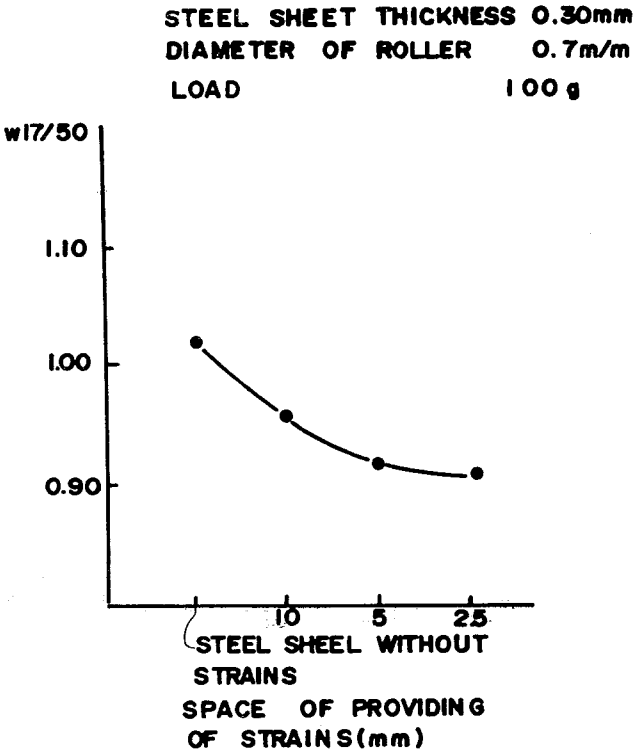
Figure 6B:
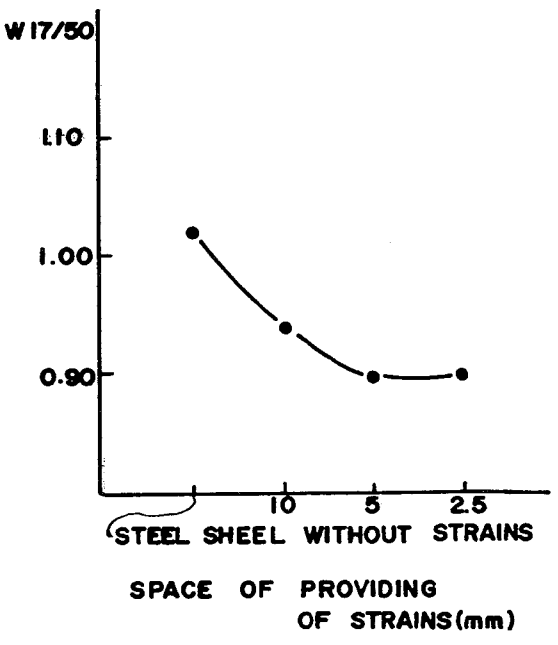

FIGS. 6 (*a*), (*b*) and (*c*) are graphs showing the relation between the distance of the impartment and the load weighted for the impartment of the fine strains.

Figure 7A:
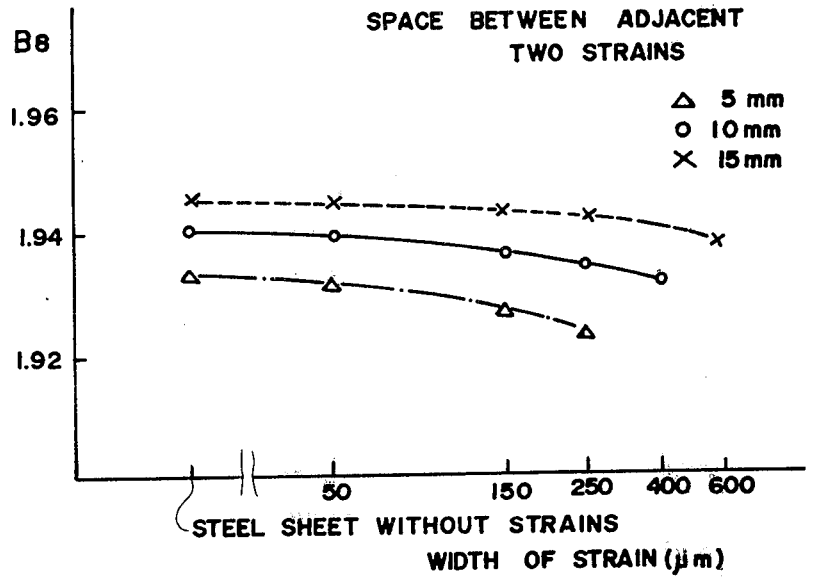
Figure 7B:
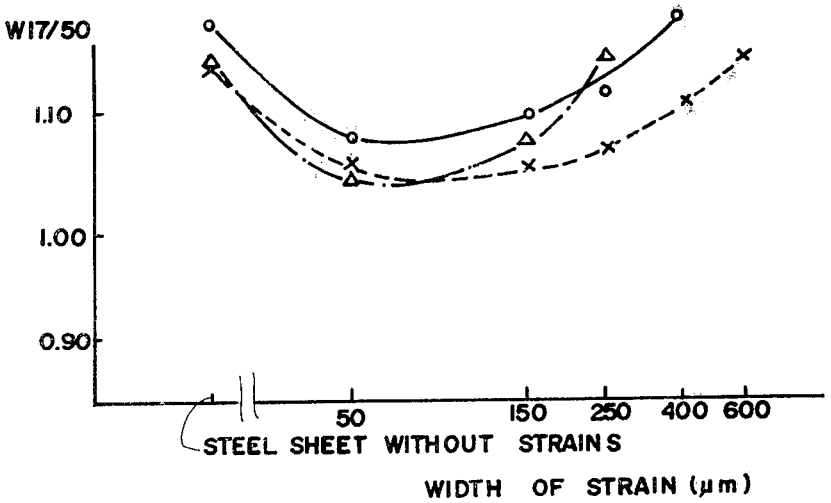

FIGS. 7 (*a*) and (*b*) are graphs showing the relations between the width of the fine strain and the flux density and between the width of the fine strain and the iron loss.

Figure 8:
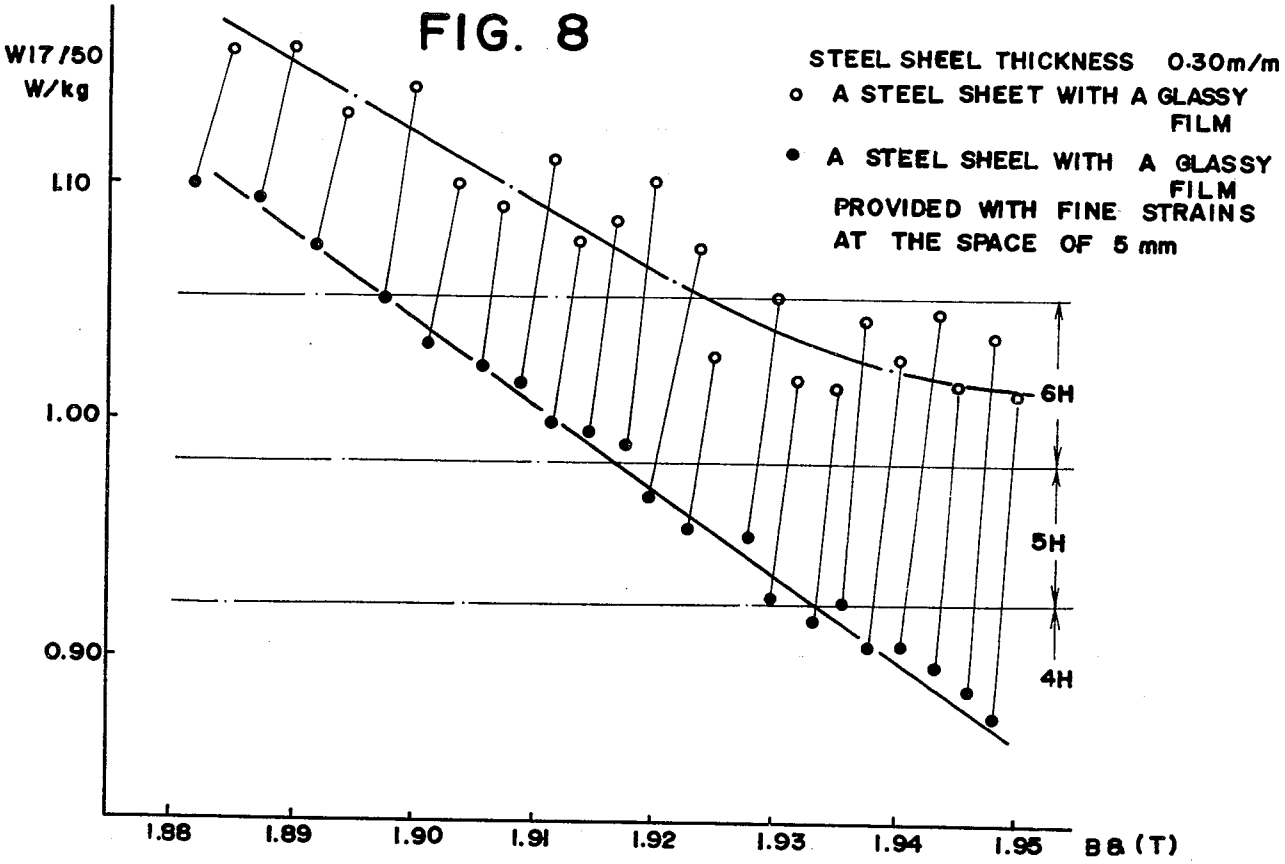

FIG. 8 is a graph showing the relation between the B8 before and after the impartment of the fine strains and W17/50.

Figure 9A:
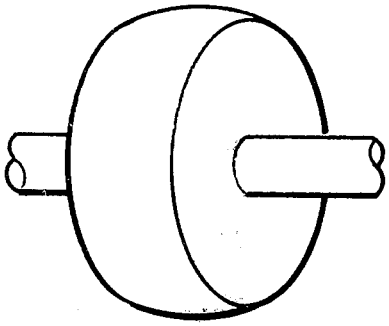
Figure 9B:
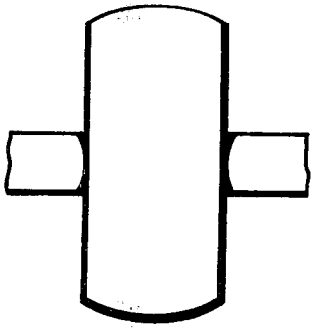

FIG. 9 (*a*) is an oblique view of one example of a preferable rollers to be employed in this invention.

FIG. 9 (*b*) is a front view of the roll of FIG. 9 (*b*).

This invention can be applied to a grain oriented electromagnetic steel sheet containing Si in an amount of 4.0% or less. If the Si content in the steel sheet exceeds 4.0%, the cold workability of the steel sheet is extremely deteriorated whereby it is made difficult to produce a grain oriented electromagnetic steel sheet industrially at this technical level.

The first feature of the grain oriented electromagnetic steel sheet of this invention is that the steel sheet has linear fine strains (which are hereinafter called liner strains or fine strains) provided thereon through an inorganic film or a glassy film consisting mainly of MgO and $SiO_2$ which is formed on the surface of the steel sheet in the course of the final annealing for obtaining a secondary recrystallization. The fine strains can be imparted to a steel sheet, for example, bringing a spherical roller, or a body of rotation, having a small diameter of 10 mm or less in contact with the steel sheet and rotatably moving it on the steel sheet while the roller is weighted down with a slight load. Of course, if the linear strains having the width of 600 μm or less can be given to the steel sheet without injuring the steel sheet, any means can be employed to impart the linear strains to the steel sheet.

Figure 1:
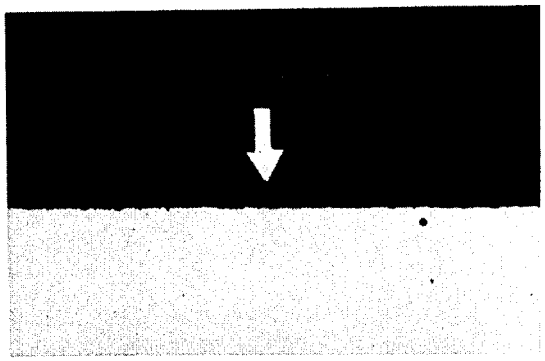
FIG. 1 (*a*) is a microphotograph (200 magnifications) of the sectional view of an electromagnetic steel sheet of this invention provided with fine strains.
Figure 1:
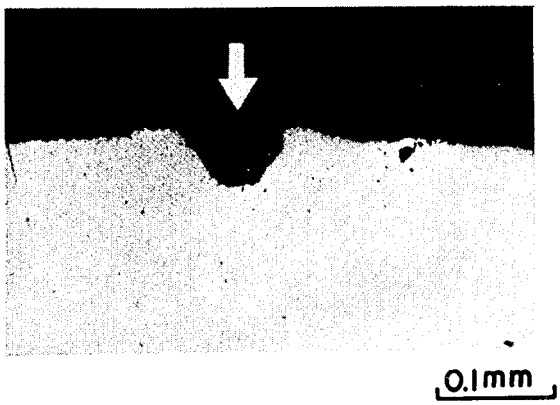

FIG. 1 (*a*) is a microphotograph of the fine strain which is the first feature of this invention. FIG. 1 (*b*) is a microphotograph of the flaw given to a steel sheet, by the sharp edge of a knife which is one of the prior means. As is noted from FIG. 1 (*b*), the flaw forms a groove on the base steel and return strains are caused on both sides of the groove. On the other hand, the fine strains of this invention are considerably fine as if the base steel was not deformed at all. The deformation only forms a slightly concave hollow or recess which can microscopically be observed. Thus, the strains of this invention are fine but, when the steel sheet to which the strains are given and the glassy coating of which are thereafter peeled off is observed by a transition pit method, it can be found that the points showing the existence of the transition form two rows of parallel lines at the distance or space of 50 μm so, as shown in FIG. 2 (*a*).

Figure 2A:
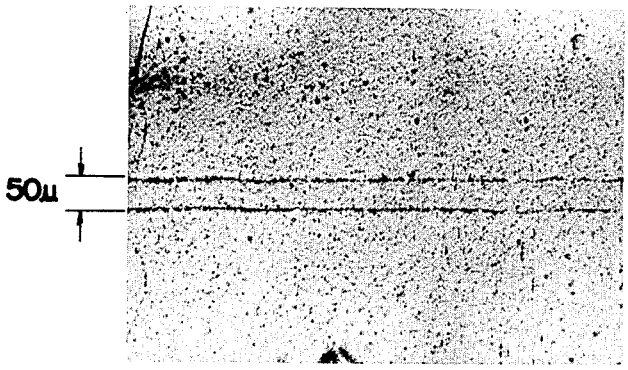
FIG. 2 (*a*) is a microphotograph (100 magnifications) showing the aspect of the fine strains observed by a transition pit method after the glassy film of an electromagnetic steel sheet of this invention with fine strains is peeled off.
Figure 2B:
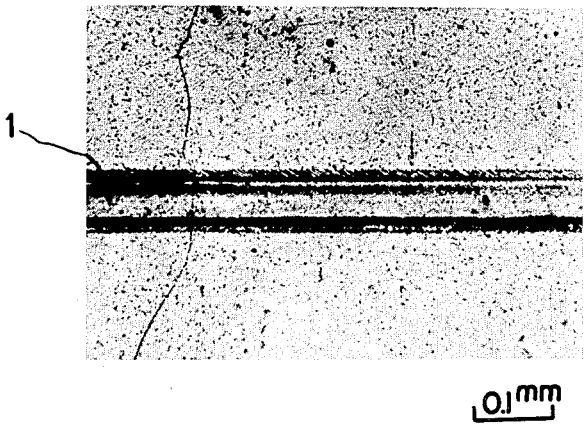
Figure 2:
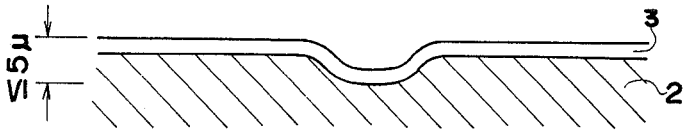
Figure 2:
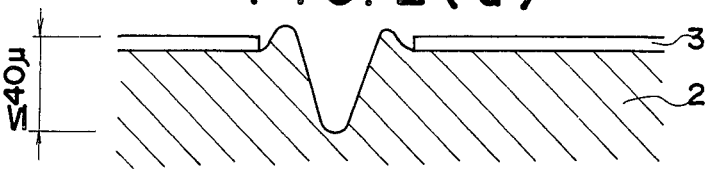
Figure 2:
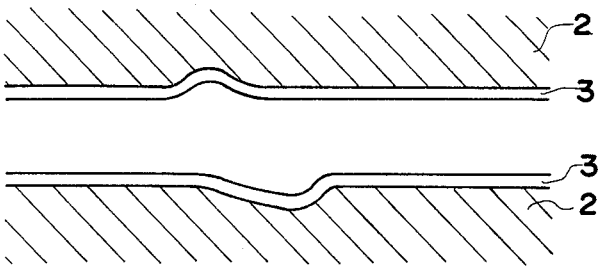
Figure 2:
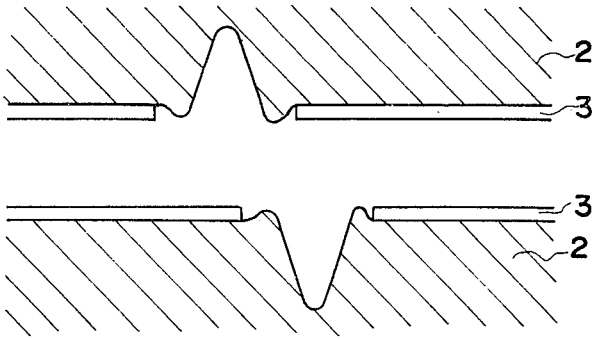

On the other hand, when the linear flaw formed by the knife is observed, it can be found that a large number of oblique sliding lines are formed with a high density since the amount of deformation is large, as shown in FIG. 2 (*b*). The occurrence of the sliding lines means that a strong shear is imparted to the steel sheet. As mentioned above, however, the fine strains of this invention are much smaller in amount of plastic deformation than the flaws provided by the knife and the former is quite different in shape from the latter. In the FIG. 2 (*b*) 1 is return strain which means the strains accumulated at both the sides of the groove.

FIG. 2 (*c*) shows an enlarged sectional view of FIG. 2 (*a*). As is noted from FIG. 2 (*c*), the glassy film of the steel sheet is not teared off, that is, the portion of the steel sheet provided with the fine strain is coated with the glassy film, and, therefore, even if the steel sheets are stacked, or piled, the current loss is not caused, as shown in FIG. 2 (*e*).

On the other hand, as is shown in FIG. 2 (*d*) which is an enlarged sectional view of FIG. 2 (*b*), the glassy film of the steel sheet is teared off at the flaw or groove portion. Consequently, when the steel sheets provided with the flaws are stacked, or piled, the currents are discharged from the grooves whereby the current loss is increased, as shown in FIG. 2 (*f*). In the above FIGS. 2 (*c*) to 2 (*f*) 2 is a base steel sheet and 3 is a glassy film.

One example of the methods for giving the fine strains of this invention to a steel sheet is described in detail below.

The feature of the method is to rotatably moving a small spherical roller made of a hard material and having its slightly convex contact surface on a steel sheet to be provided with fine strains while the roller is weighted down with a slight load.

The fine strains can be given to the base steel without injuring the surface of the steel sheet including its glassy film by this method since the small roller having the slightly convex surface is rolled on the surface of the steel sheet while the roller is weighted down with the slight load, as stated above. It is preferable that the diameter of the roller is between 0.2 and/0 mm. The width of the linear strain imparted by the roller having such a width is between 10 and 600 μm, preferable 300 μm or less. It is, however, undesirable to use a roller having its width larger than the above range since the inner region defined by the parallel lines shown in FIG. 2 (*a*) becomes too broad. To the contrary, in case that the diameter of the roller ball is smaller than the above range, it becomes easy to injure the surface of the steel sheet and the glassy film. The depth of the slightly concave hollow formed by the provision of the linear strain of this invention is 5 μm or less, ordinarily 1 μm or so. If the depth of the concave hollow exceeds 5 μm, the flux density is greatly deteriorated and the shape of the hollow becomes bad.

The above is only one example of the methods for giving the fine strains to a steel sheet. As another method, for example, a small disc having the large thickness and having the concave contact surface traverse to the moving direction may rotatably be moved on the surface of the steel sheet while the disc is weighted down with a load. In addition, the above-stated roller, disc or a ball may be slid on the steel sheet without injuring it.

In order to reduce the iron loss it is preferable that the strains are given to the steel sheet in such an amount that the two row of parallel lines can be observed as transition pits. The strains exceeding the amount partially causes the great roughness on the surface of the steel sheet whereby it is prevented to obtain an expected magnetism or the space factor is deteriorated. Furthermore, the strains may be given either to both side surfaces of the steel sheet or to only one side surface.

Thus, one of the features of this invention is to give the fine strains to the surface of the base steel of the steel sheet. In addition, the steel sheet provided with the fine strains may have a glassy film or a secondary coating thereon, as described later. Of course, the fine strains can be given directly to a steel sheet which does not have such a coating or film.

The reasons why it is preferable to give the strains to the base steel sheet through the glassy film which is the second one of the features of this invention are described below.

The glassy film is mainly made of the MgO applied prior to a final annealing and the Si contained in the steel sheet. The film acts not only to prevent the occurrence of the curing during the final annealing but also to give a tension to the surface of the steel sheet so as to decrease the iron losses. However, the removal of the glassy film requires the use of such a strong acid as a fluoric acid or a hydrochloric acid and a long time pickling which means the addition of one step in an industrial treating line. Besides, the magnetism of the steel sheet is deteriorated by the disappearance of the tension effect and the surface roughness of the steel sheet due to the pickling. Such disadvantages offset the effects obtained by giving the fine strains to the steel sheet.

Figure 3:
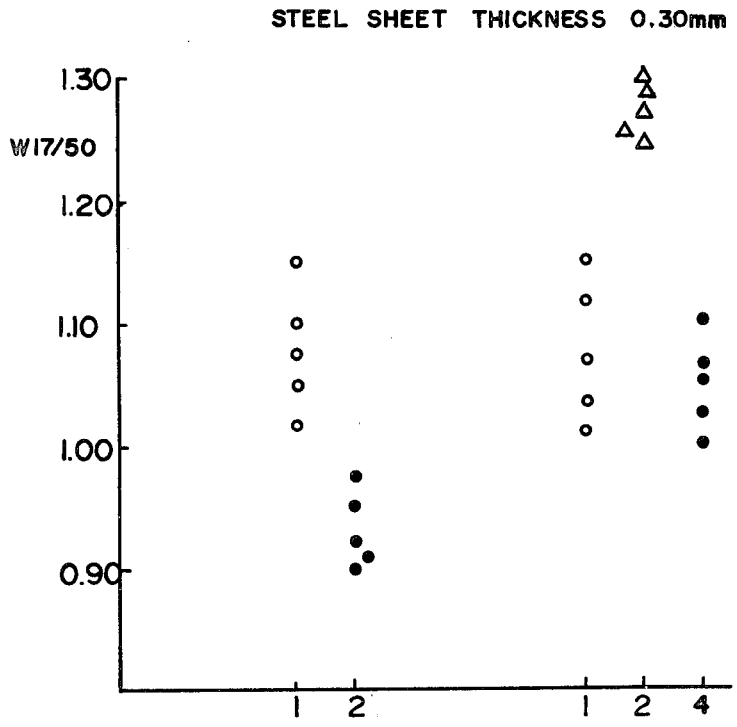
FIG. 3 is a graph showing the characteristics of the iron loss before and after the impartment of fine strains.

In the prior method of using a knife, the surface flaws have been given directly to the base steel of the steel sheet. Therefore, it is found that the prior method is inferior in effect to this invention, when the former is compared with the latter on the basis of the magnetism before removal of the film, as shown in FIG. 3. However, the fine strains of this invention can also be given directly to the surface of the steel sheet without pickling, in case that the steel sheet is finally annealed in a final annealing step which does not require the use of such an annealing separating agent is MgO, for example, in a continuous annealing furnace.

The direction of the line of the linear fine strain of this invention is described in detail below.

FIG. 4 (*a*) is a graph showing the change of the iron loss (W17/50) at the time when the fine strains are given to only one side surface of a steel sheet through its glassy film in the direction of the angle $\alpha$ to the rolling direction and, therewith, the steel sheet is magnetized at the rolling direction (L direction).

In $\alpha < 10°$ the iron loss is rather deteriorated but it is decreased as the $\alpha$ is increased. In $\alpha \geqq 30°$ the iron loss is 5% or more and in $\alpha \geqq 45°$ it shows the rate of improvement of 10% or more. Accordingly, in order to greatly improve the iron loss the angle $\alpha$ should be made 30° or more, preferably 40° or more. In case that the steel sheet is employed as a core for coiled iron core, only the iron loss of the L direction may be taken into account, but it becomes important to take account of the iron loss at the time when the steel sheet is magnetized in the direction (C direction) right-angled to the rolling direction, namely the iron loss of the C direction, in dependence on the use of the steel sheet.

The iron loss of the C direction can be improved by decreasing the angle $\alpha$ in contrast with the iron loss of the L direction. As is understood from FIG. 4 (*b*), for example, it is preferable that the line of the fine strain is provided in the direction that the angle $\alpha$ meets the range between $+°$ and 80° from the viewpoint of the improvement of the magnetism of both the L and C directions. In addition, the line is not always a straight line but it may be a curved line, a zig-zag line or a waved line. Moreover, the lines may intersect on the steel sheet.

A preferable distance, or space, between the adjacent two fine strains is stated below.

FIG. 5 is a graph showing the relation between the iron loss and the distance between the adjacent two fine strains in case that the roller having the diameter of 0.7 mm with a load of 200 g is rotatably moved on the glassy film having the thickness of about 1 μm in the C direction. From FIG. 5 it is noted that the optimum distance is 2.5 to 10 mm. The value of the iron loss approaches the value before the providing of the fine strains the more nearly, the shorter the distance becomes. When the distance becomes 0.6 mm, the iron loss becomes the same value as that before the impartment of the fine strains.

In the same manner as the above the magnetic flux density (B8) is deteriorated the more remarkably, the shorter the distance becomes. It is noted from FIG. 5 that, when the distance is made from 2.5 mm to 1.25 mm the flux density is deteriorated in an amount of about 0.01 (T) and when the distance is made from 1.25 mm to 0.6 mm, the density is deteriorated in an amount of about 0.02 (T). In this connection, the example in which the flaws having the depth of 10 μm are given to the same steel sheet at the distance of 0.6 mm in the C direction by a needle having a sharp tip end is shown by a mark O in FIG. 5. From the example it is understood that both the iron loss (1.25 W/Kg) and the B8 are rapidly deteriorated from the values before the provision of the flaws and the provision of large strains at small distance has rather bad influences on the steel sheet.

Of course, the optimum distance is changed depending upon the weight of the load imparted. As is shown in FIGS. 6 (*a*), (*b*) and (*c*), for example, in case that the roller has the diameter of 0.7 mm, the optimum distance is made large as the weight of the load is increased. Furthermore, as is understood from FIGS. 7 (*a*) and (*b*), the magnetism is also fluctuated depending upon the change of the width of the strain itself. That is, when the distance is 5 mm and the width is 250 μm, the iron loss becomes the same value as that before the impartment of the fine strains and, when the distance is 10 mm and the width is 400 μmm, the iron loss returns back to the same value. In addition, in case that the distance is 15 mm and the width is 600 μm, the iron loss becomes the same value as that before the impartment of the fine strains. In the same manner as the above, the B8 is reduced in an amount of about 0.01 (T) in the respective 250 μm, 400 μm and 600 μm. Accordingly, the width of the fine strain itself should be made 600 μm or less, preferably 300 μm or less. It is, thus, understood from FIGS. 5 to 7 (*b*) that the optimum distance between the adjacent two strains and the optimum wide of the fine strain should be determined, case by case, considering the weight of the load to be imparted, how to give the fine strains to the steel sheet and the thickness of the glassy film but that they should not be made less than 2.5 mm and more than 600 μm. In FIGS. 7 (*a*) and (*b*) the fine strains are given to a steel sheet by the use of a roller having the diameter of 0.7 mm and the width of the strain is broadened by rotatably moving the roller on the steel sheet repeately.

On the other hand, in the prior method using a knife which leaves flaws the preferable distance is between 0.1 and 1 mm. Therefore, in this invention the fine strains can be given to the steel sheet with less density than that in the prior method whereby the time and labor for giving the fine strains to the steel sheet can greatly be reduced. In addition, the deterioration of the excitation characteristics (B8) caused by the provision of the flaws is as much as 0.02 T or so in the prior method but in this invention the deterioration can be reduced to the minimum, i.e. 0.01 T or less. In this respect, the B8 shows the magnetic flux density in 800 A/m.

It is preferable to put a steel sheet or steel strip in the condition that a tension is preliminarily imparted thereto, in case that the impartment of the fine strains is made in a continuous treating line, since the tension acts not only to bear the load necessary to give the strain to the steel sheet but also to further promote the effect obtained by the impartment of the strain.

The glassy film formed in the final annealing has the thickness of 1 to 3 μm and the thickness of such a degree is optimum to give the fine strains to the steel sheet. However, when the thickness of the glassy film is 5 μm or less, the fine strains can be given to the steel sheet without injuring the film.

The coating solution or agent to be applied for forming the glassy film prior to the final annealing consists mainly of MgO, and $TiO_2$, the compounds of boron, sulfides or the compounds of antimony may be added thereto in order to improve the adhesion or magnetism of the film.

When this invention is applied to an electromagnetic steel sheet having such a high magnetic flux density that B8 is 1.90 To or more, the effect of this invention is further enhanced. FIG. 8 is a graph showing the relation between the B8 and the values of the iron loss (W17/50) before and after fine strains are imparted to a steel sheet having the thickness of 0.30 mm. The increase of the B8 before the impartment of the fine strains reduces the iron loss but the grade of the reduction becomes loose gradually as the B8 increases. When B8 > 1.93 T, the iron loss appears to approach the saturation point. On the other hand, the iron loss after the impartment of the fine strains is changed, or decreased, more rapidly than the iron loss before the impartment in accordance with the increase of the B8, that is the absolute value of the grade of the reduction is larger than that before the impartment. In addition, the iron loss is reduced down to a high B8, i.e. 1.95 T, and it does not show the saturation tendency. Accordingly, it is understood from FIG. 8 that the effect obtained by the impartment of the fine strains becomes the more marvelously, the higher the B8 becomes. In the prior method the increase of the B8 has not been sufficiently reflected upon the improvement of the iron loss but in this invention it has been made possible to reflect the enhancement of the B8 directly upon the decrease of the iron loss. In this invention, thus, the marvelous low values of the iron loss have been obtained as follows:

If B8 ≧ 1.90 T, W17/50 ≲ 1.03 W/Kg;
if B8 ≧ 1.92 T, W17/50 ≲ 0.96 W/Kg; and
if B8 ≧ 1.94 T, W17/50 ≲ 0.90 W/Kg:

In case that a material showing such a very low iron loss that the W17/50 is 0.90 W/Kg or less is used in such an electrical equipment as a transformer, it reduces power loss in an amount of 10% or more, as compared with the power loss of the material having a low iron loss which is used in an conventional equipment of the highest grade. Therefore, the effect of this invention is immeasurable at the present time when the saving of energy is required worldwidely.

The step for the impartment of the fine strains of this invention may be put into any position after the secondary recrystallization is completed. For example, the step may be provided right after the final annealing step or it may be positioned after the heat flattening step. In case of a continuous final annealing line, the step for the impartment of the fine strains can be placed in the course of cooling. However, the fine strains should be given to a steel sheet at a temperature of 800° C. or less, preferably 700° C. or less.

The steel sheet provided with the fine strains as it is can be made a final product, but in general it is coated with the compounts of phosphoric acid system or of organic system as a secondary coating so that the insulation of the steel sheet is improved and thereafter the steel sheet is made a final product. The secondary coating should be carried out at a temperature of 800° C. or less, preferably 700° C. or less. In the case, an ultraviolet ray-hardening resin can be employed as the secondary coating material instead of the above compounds.

In case that the steel sheet is provided with the fine strains after the secondary coating is formed thereon or after the steel sheet with the secondary coating is punched out, it is important to take the following matter into consideration. That is, the case that the fine strains are imparted to the steel sheet through the secondary coating requires heavier load than the case that the fine strains are given to the steel sheet through only the glassy film. Therefore, the fine strains must be imparted to the steel sheet so as not to injure the secondary coating. Of course, when the secondary coating formed is a thin and strong one, it is possible to decrease the iron loss without injuring the insulation even if the fine strains are imparted to the steel sheet through the secondary coating.

The shape of the roller, or a body of rotation, suitable for giving the linear fine strains to a steel sheet is explained below.

One typical example of the preferable shapes of the roller is shown in FIGS. 9 (*a*) and (*b*). As is noted from FIGS. 9 (*a*) and (*b*) the surface of the roller contacting with the surface of the steel sheet to be provided with the fine strains is made slightly convex in order to provide the base steel with the fine strains of a slightly concave hollow without injuring the glassy film or the secondary coating. Therefore, it is not that the roller to be employed for this invention is limited to the shape of the typical example but that any shapes of rollers can be employed if their surfaces contacting with the surface of the steel sheet are made slightly convex, in the direction traverse to the moving direction.

In addition, the lower iron loss can be obtained by the providing of the fine strains, the higher the B8 of the steel sheet is or the lower the iron loss of the steel sheet before providing the fine strains is. Therefore, the effect of this invention can be enhanced by finishing the steel sheet subjected to a final annealing to a mirror or speculum condition before the steel sheet is provided with the fine strains.

Examples of this invention are described below.

EXAMPLE 1

A steel ingot composed of 0.051% C, 2.95% Si, 0.083% Mn, 0.01% P, 0.025% S, 0.027% Al, 0.0076% N, the rest Fe and a very small amount of unavoidable impurities is subjected to a series of a hot rolling, an annealing, a rapid cooling, a cold rolling, a decarburization annealing, a MgO coating and a final annealing in order whereby a secondary recrystallization is completed. The grain oriented silicon steel sheet thus produced has the thickness of 0.30 mm and is coated with a glassy film having the thickness of 1.5 μm. Linear fine strains are imparted to one side surface of the steel sheet by rotatbly moving a roller having the diameter of 0.7 mm straightly on the steel sheet at the space of 10 mm in the C direction while the roller is weighted down with 200 g load. The magnetisms of the rolling direction of the steel sheet before and after the impartment of the fine strain are as follows:

Before the impartment; when B8=1.930 T, W17/50=1.10 W/Kg.

After the impartment; when B8=1.927 T, W17/50=0.97 W/Kg.

As is noted from the Example, the iron loss is greatly improved in this invention.

EXAMPLE 2

A steel ingot composed of 0.048% C, 2.93% Si, 0.085% Mn, 0.008% P, 0.026% S, 0.025% Al, 0.0072% N, the rest Fe and a very small amount of unavoidable impurities is subjected to a series of a hot rolling, an annealing, a cold rolling, a decarburization annealing, a MgO coating and a final annealing in order whereby a secondary recrystallization is completed. The grain oriented silicon steel sheet thus produced has the thickness of 0.30 mm and is coated with a glassy film. The steel sheet is further subjected to a heat flattening treatment and, thereafter, linear fine strains are imparted to one side surface of the steel sheet by rotatably moving a roller having the diameter of 0.5 mm straightly on the steel sheet at the space of 8 mm in the C direction while the roller is weighted down with 150 g load.

The magnetisms of the rolling direction of the steel sheet before and after the impartment of the strains are as follows:

Before the impartment; when B8=1.950 T, W17/50=1.02 W/Kg.

After the impartment; when B8=1.948 T, W17/50=0.89 W/Kg.

In addition, the space factor, or stacking factor, measured in accordance with the method defined in Japan Industrial Standard is 97%. On the other hand, the same steel sheet with the glassy film is provided with linear flaws at the same space by the sharp edge of a knife. In the case the space factor is 95%.

EXAMPLE 3

A steel ingot composed of 0.045% C, 3.05% Si, 0.040% Mn, 0.005% P, 0.006% S, 0.089% Sb, 0.030% Se, the rest Fe and a very small amount of unavoidable impurities is subjected to a series of a hot rolling, an annealing, a cold rolling, a decarburization annealing, a MgO coating and a final annealing in order whereby a secondary recrystallization is completed. The grain oriented silicon steel sheet thus produced has the thickness of 0.35 mm and is coated with a glassy film. Linear fine strains are given to both side surfaces of the steel sheet by straightly sliding a roller having the diameter of 1 mm on the steel sheet at the space of 10 mm in the direction of 35° to the C direction while the roller is weighted down with 300 g load. The magnetisms of the steel sheet before and after the impartment of the strains are as follows:

Before the impartment:

L direction; when B8=1.95 T, W17/50=1.17 W/Kg;

C direction; when B8=1.35 T, W13/50=2.92 W/Kg.

After the impartment:

L direction; when B8=1.95 T, W17/50=0.99 W/Kg;

C direction; when B8=1.34 T, W13/50=2.22 W/Kg.

EXAMPLE 4

A steel ingot composed of 0.049% C, 2.95% Si, 0.080% Mn, 0.025% S, 0.028% Al, 0.0070% N, the rest Fe and a very small amount of unavoidable impurities is subjected to a series of a hot rolling, an annealing, a cold rolling, a decarburization annealing and a final annealing in order whereby a secondary recrystallization is completed. The grain oriented silicon steel sheet thus produced is further coated with the solution containing phosphoric acid and chromic acid as main components and thereafter is cured at the temperature of 800° C. to produce a secondary coating thereon. Linear fine strains are imparted to one side surface of the steel sheet with the secondary coating by rotatably moving two rollers having the diameters of 1 mm and 10 mm on the steel sheet at the space of 5 mm in the direction right angled to the rolling direction. The magnetisms of the steel sheet before and after the impartment of the strains are as follows:

| | | $B_8$ (T) | W 17/50 (W/Kg) |
|---|---|---|---|
| A | Before the impartment | 1.940 | 1.03 |
| | After the impartment (diameter: 1 mm) | 1.938 | 0.92 |
| B | Before the impartment: | 1.938 | 1.03 |
| | After the impartment (diameter: 10 mm) | 1.934 | 0.94 |

Remarks

A transition pit method (electrolytic corrosion)

| | | |
|---|---|---|
| electrolytic solution: | chromic anhydride | 50 g |
| | glacial acetic acid | 130 cc |
| | water | 180 cc |
| current density: | about 3A/cm$^2$ | |
| Corrosion time: | about 2 minutes | |
| washing: | 30% hydrochloric acid | |

We claim:

1. A method of treating a grain oriented steel to improve the iron loss which comprises treating a grain oriented electromagnetic steel sheet containing a glassy film formed by an annealing separator on the surface thereof and which sheet has been subjected to a finished annealing operation by imparting a plurality of linear strains to the base steel sheet through the glassy film by forcefully moving a rotatable body over the glassy film, said linear fine strains being formed at an angle of 45° or more to be the rolling direction of the steel sheet said linear strain having a depth of 5 μm or less, a width of 600 μm or less and wherein the distance between adjacent strains is 2.5 to 15 mm.

2. A method according to claim 1 in which a secondary coating is formed over said glassy film and the rotatable body is forcefully moved over the secondary coating to impart the linear fine strains to the base steel sheet through the coatings, said secondary coating being selected from the group consisting of compounds of phosphoric acid, organic compounds and an ultraviolet ray-hardening resin to improve the insulation of the steel sheet.

3. A method according to claim 1, wherein the rotatable body is a spherical roller having a convex contact surface.

4. A method according to claim 1 in which the direction of the strains to be imparted is substantially traverse to the rolling direction.

5. A method according to claim 1 in which the excitation characteristics (B8) of the base steel sheet subjected to the finishing annealing is 1.90 or more.

6. A method according to claim 1 wherein the distance between adjacent strains is 2.5 to 10 mm.

7. A grain oriented magnetic steel sheet having a glassy film on the surface thereof, which steel sheet has been subjected to a finishing annealing, said steel sheet containing silicon in an amount of 4.0% or less and being characterized in that it contains a plurality of strains imparted through the glassy film by a rotatable body, in which the strains have a depth of 5 μm or less, a width of 600 μm or less and the distance between the adjacent strains being 2.5 to 15 mm and wherein the direction of the fine strains is at an angle of 30° or more to the rolling direction of the steel.

8. A grain oriented electromagnetic steel sheet according to claim 7 in which the direction of the strain is traverse to the rolling direction.

9. A grain oriented electromagnetic steel sheet according to claim 7 in which the excitation characteristics (B8) of the base steel sheet subjected to the final annealing is 1.90 or more.

10. A grain oriented electromagnetic steel sheet according to claim 7 in which the base steel sheet has a further coating consisting essentially of one member of the group consisting of compounds of phosphoric acid system, compounds of organic system and a ultraviolet ray hardening resin on the film.

11. A grain oriented electromagnetic steel sheet according to claim 7 in which the direction of the fine strains is 45° or more to the rolling direction of the steel sheet.

12. A steel sheet according to claim 7, wherein the distance between adjacent strains is 2.5 to 10 mm.

* * * * *